US005219025A

United States Patent [19]

Berger et al.

[11] Patent Number: 5,219,025

[45] Date of Patent: Jun. 15, 1993

[54] METHOD AND APPARATUS FOR GRAVEL PACKING A WELL THROUGH A TUBING STRING

[75] Inventors: David J. Berger, Flower Mound; Thomas G. Whiteley, Houston, both of Tex.

[73] Assignee: Otis Engineering Corporation, Dallas, Tex.

[21] Appl. No.: 867,130

[22] Filed: Apr. 10, 1992

[51] Int. Cl.[5] ..... E21B 43/04

[52] U.S. Cl. ..... 166/278; 166/51

[58] Field of Search ..... 166/278, 381-387, 166/51

[56] References Cited

U.S. PATENT DOCUMENTS

| | | | |
|---|---|---|---|
| 3,602,307 | 8/1971 | Price et al. | 166/278 |
| 3,726,343 | 4/1973 | Davis, Jr. | 166/278 |
| 3,913,675 | 10/1975 | Smyrl | 166/278 |
| 3,963,076 | 6/1976 | Winslow | 166/278 |
| 4,570,714 | 2/1986 | Turner et al. | 166/278 |
| 4,635,725 | 1/1987 | Burroughs | 166/51 X |
| 4,856,590 | 8/1989 | Caillier | 166/278 |
| 4,858,690 | 8/1989 | Rebardi et al. | 166/51 X |
| 4,860,831 | 8/1989 | Caillier | 166/384 |

*Primary Examiner*—Thuy M. Bui

*Attorney, Agent, or Firm*—Mason M. Campbell

[57] ABSTRACT

A gravel packing assembly which may be utilized in a method to gravel pack a well through the tubing string. The gravel pack assembly includes a crossover assembly which facilitates the pumping of a gravel slurry into a wellbore, and the taking of the fluid return through the tubing string. A gravel pack screen will be coupled in the assembly beneath the crossover assembly to facilitate the conventional placement of the gravel pack. After the placement of gravel in the well, the crossover assembly may be removed from the well, leaving the screen in place with the gravel pack.

14 Claims, 4 Drawing Sheets

METHOD AND APPARATUS FOR GRAVEL PACKING A WELL THROUGH A TUBING STRING

BACKGROUND OF THE INVENTION

The present invention is directed generally to systems for gravel packing of wells, and more particularly is directed to systems which facilitate the gravel packing of wells, and particularly circulating gravel packing of wells, through a tubing string.

It is well known in the oil and gas industry to gravel pack wells penetrating unconsolidated earth formations to prevent disadvantageous deterioration or collapse of the formation proximate the wellbore. Circulating gravel packing includes the placing of a slurry containing the gravel into the well to a location proximate the formation, with the slurry fluid being returned through a screen to the surface, leaving the solids proximate the formation.

Conventional gravel pack tools are designed to be lowered through the casing, typically on the end of a tubing string. Conventional gravel pack tools are substantially larger than the tubing string. The problem, therefore, with conventional apparatus involves their use in existing wells, where tubing is already in place. Where it is determined that gravel packing of a well would assist in obtaining or maintaining production, conventional available techniques would have required either the removal of the existing tubing string from the well to facilitate introduction of conventional gravel pack tools into the well; or the pumping of a gravel slurry in a gel carrier through the tubing string. The pulling of the existing tubing string is a relatively expensive operation which in most cases will not be practical for work over wells. At the same time, however, the pumping of a gel-carried gravel slurry will typically not yield the same benefits of formation control as would be obtained with a circulating gravel pack, due to factors such as the difficulty in placing the slurry completely across an interval, etc.

Accordingly, the present invention provides a new method and apparatus for performing a circulating gravel pack through the tubing string, thereby facilitating the gravel packing of wells in a manner not obtainable with prior art methods and apparatus.

SUMMARY OF THE INVENTION

Methods and apparatus in accordance with the present invention, facilitate a circulating through tubing gravel pack. Preferably, this gravel pack will be performed through use of a gravel packing assembly which will be lowered into the well, through a previously-placed tubing string, on a small diameter (or "secondary") tubing string. The gravel pack assembly will be inserted through the tubing string, preferably until at least the gravel pack screen extends beneath the lowermost termination of the preexisting (or "primary") tubing string.

In one preferred embodiment of a gravel packing apparatus in accordance with the present invention, the gravel pack apparatus includes a crossover assembly which is insertable through the tubing string, and which is coupled to a gravel pack screen. A tubing packer assembly is coupled to the crossover assembly, and is configured to establish a seal between the crossover assembly and the primary tubing string. The crossover assembly will include a plurality of flow passages. A first set of passages will communicate the interior of the secondary tubing string with the exterior of the crossover tool and screen, so as to facilitate the placement of a gravel slurry in a lower borehole annulus external to the gravel pack screen. Additionally, the gravel pack assembly will provide a flow path from within the gravel pack screen to the annulus between the secondary tubing string and the primary tubing string, above the packer assembly, to facilitate the return of fluids from the gravel pack slurry to the surface. In one preferred embodiment of the invention, the gravel pack assembly includes a base pipe coupled to the crossover assembly and extending into the gravel pack screen. The base pipe adds substantial strength and rigidity to the gravel pack screen to facilitate the placement of gravel pack assembly at a desired location within the well, and further facilitates the effective and even placement of gravel within the well annulus. After completion of the gravel pack operation, the crossover assembly and the base pipe are preferably removed from the screen to facilitate production from the well in a conventional manner.

DETAILED DESCRIPTION OF THE PREFERRED EMBODIMENTS

Figure 1:
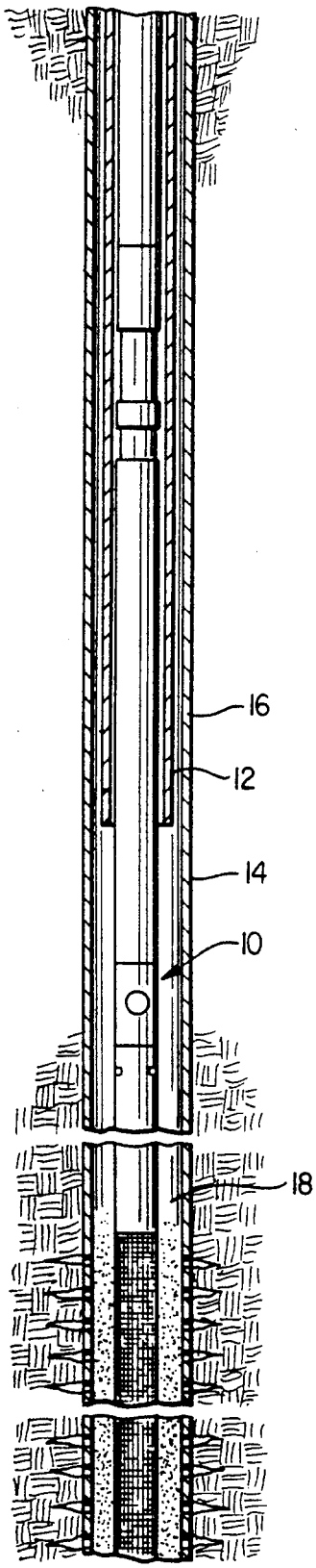
FIG. 1 depicts an exemplary apparatus in accordance with the present invention disposed within a well, illustrated partially in vertical section.

Referring now to the drawings in more detail, and particularly to FIG. 1, therein is shown an exemplary through tubing gravel pack apparatus, indicated generally at 10, partially disposed within a tubing string 12 in a wellbore 14. Wellbore 14 is lined with casing 16 in a conventional manner. Gravel pack apparatus 10 is depicted at the completion of the placement of gravel in annulus 18 surrounding apparatus 10 within casing 16.

Figure 2A:
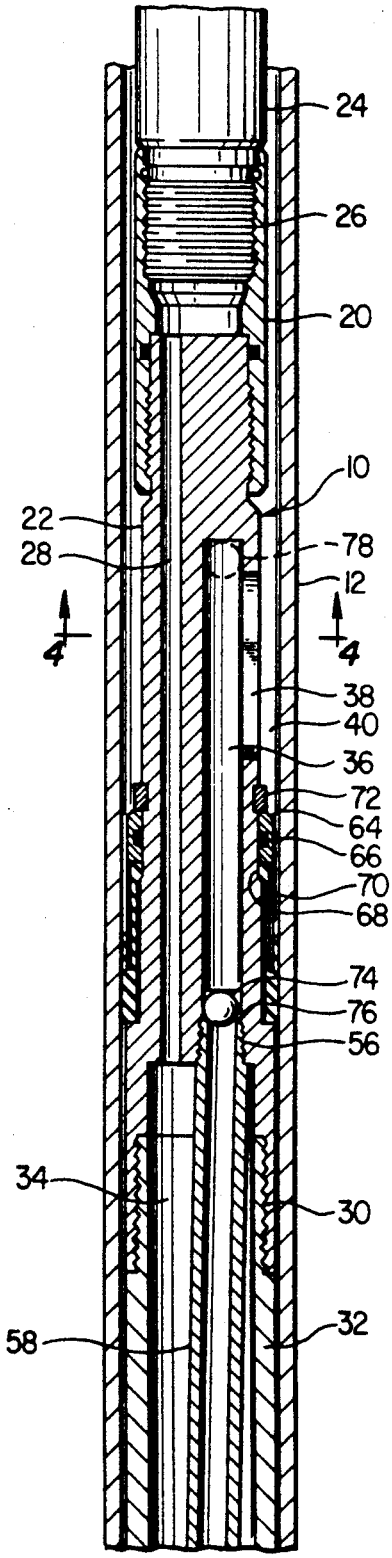
FIGS. 2A-C depict the gravel pack apparatus of FIG. 1 in greater detail, and partially in vertical section.
Figure 2B:
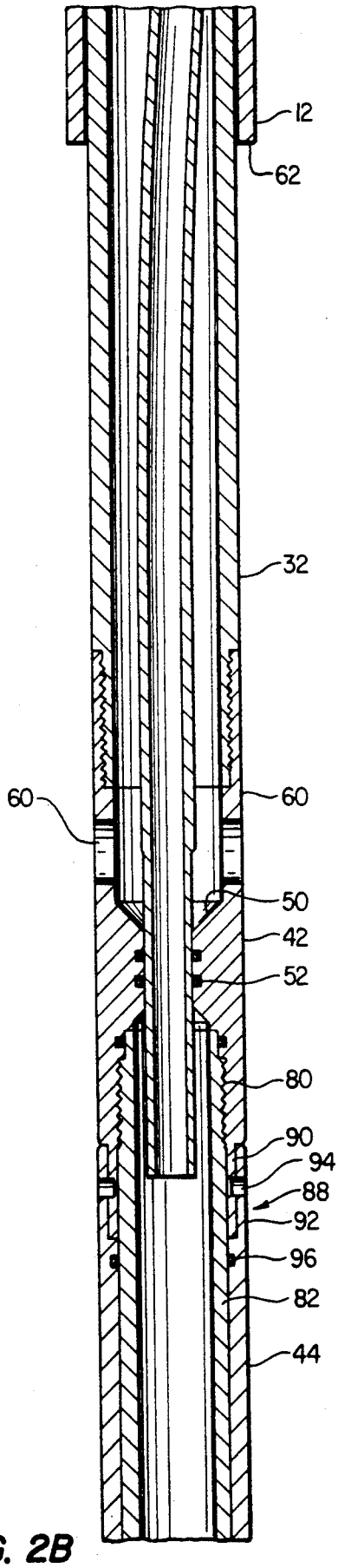
Figure 2C:
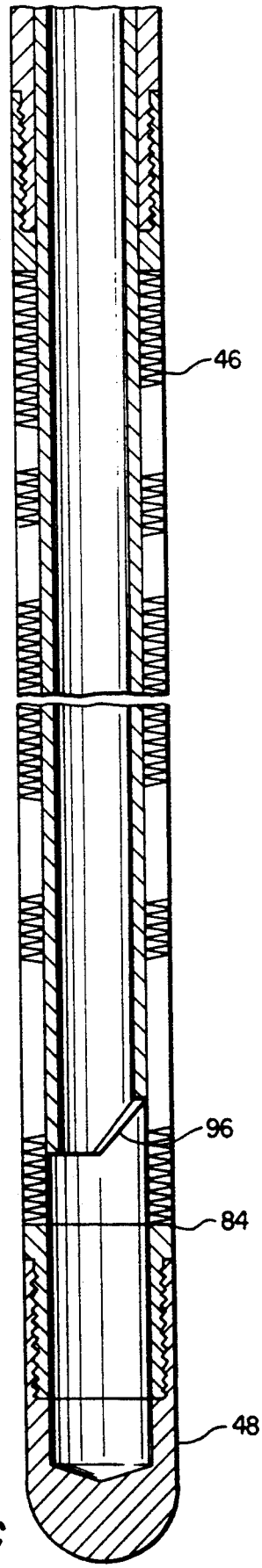
Figure 3A:
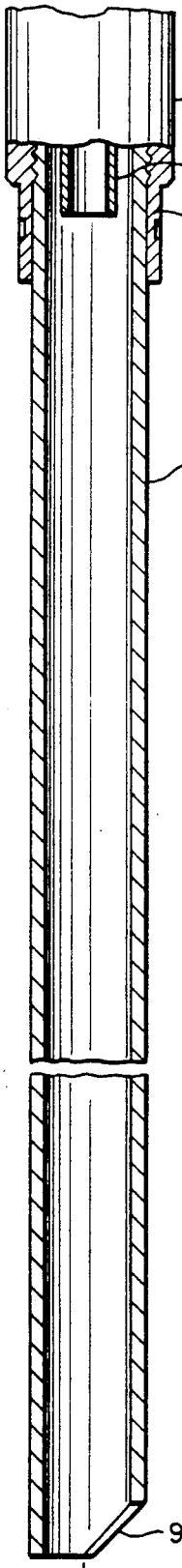
FIGS. 3A-B depict the washpipe assembly and screen assembly of the gravel pack apparatus of FIG. 2, depicted partially in vertical section.
Figure 3B:
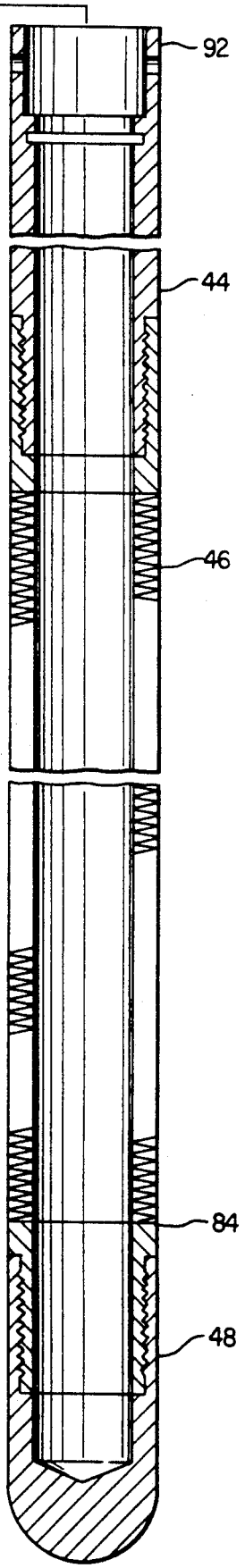
Figure 4:
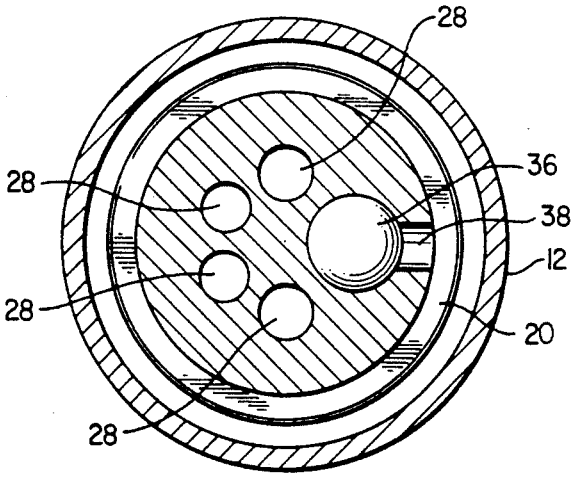
FIG. 4 depicts the gravel pack apparatus of FIG. 2, illustrated along Section Lines 4—4 in FIG. 2A.

Referring now also to FIG. 2, therein is depicted gravel pack apparatus 10 in greater detail, and partially in vertical section, again partially disposed within tubing 12. At its upper end, gravel pack apparatus 10 includes a coupling sub 20 adapted to threadably engage an upper housing 22, and to facilitate coupling of gravel pack apparatus 10 to a small diameter tubing string 24. In one exemplary preferred configuration of gravel pack apparatus 10, coupling sub 20 will include at its upper end a thread 26 to facilitate attachment to small diameter tubing string 24, which will preferably, in this exemplary embodiment, have an outside diameter of approximately 2.002 inches. In one preferred embodiment, this thread will be a 1.660 OD 10 RD. 3/4 T.P.F. special clearance box thread.

Gravel pack assembly includes a crossover assembly including an upper housing 22 and a pup joint housing 32. Upper housing 22 includes a plurality of generally longitudinally disposed flow passages 28. Pup joint housing section 32 defines a fluid chamber 34 which is in fluid communication, through flow passages 28, with the interior of small diameter tubing string 24. Upper housing 22 also includes a return passage 36 formed by a passageway extending proximate the lower portion of upper housing 22, but terminating in a radial aperture 38 providing fluid communication to the exterior annulus 40 around gravel pack apparatus 10 within tubing 12.

Upper housing 22 is threadably coupled at 30 to pup joint housing section 32. Coupled proximate the lower end of pup joint housing section 32 is ported sub 42. Ported sub 42 provides a coupling between pup joint housing section 32 and screen extension sub 44. Ported sub 42 includes a radially inward annular extension 50 having a plurality of O-rings 52 installed thereon in a conventional manner. A bypass tube 58 is threadably coupled at 56 to upper housing 22, in fluid communication with return passage 36. By-pass tube 58 extends through fluid chamber 34, and through ported sub 42, with the exterior of by-pass tube 58 sealingly engaging annular extension 50 in ported sub 42 through action of O-rings 52.

Coupled to the bottom of screen extension sub 44 is gravel pack screen 46, which is in turn coupled at its lower end to bull plug 48.

A plurality of gravel pack flow ports 60 provide fluid communication between fluid chamber 34 and the exterior of gravel pack apparatus 10. As can be seen in FIGS. 1 and 2B, gravel pack apparatus 10 will preferably be installed, in an operative configuration, such that gravel pack flow ports 60 are located beneath the termination 62 of tubing 12.

As can best be seen in FIG. 2A, coupled to the exterior of upper housing 22 is tubing packer cup 64. Tubing packer cup 64 is preferably a partially elastomeric cup which is sealingly secured to upper housing 22, such as through use of an O-ring 66. Tubing packer cup 64 may include an inwardly extending upset 68 which rests against a shoulder 70 formed on the exterior of upper housing 22. In such a configuration, tubing packer cup 64 may be retained in place through action of an appropriate mechanism, such as a snap ring 72. Tubing packer cup 64 is sized to facilitate the establishing of a seal between upper housing 22 and the interior of tubing 12 in response to a pressure differential biased from the lower side; but to allow the by-pass of fluid downwardly through exterior annulus 40 toward termination 62 of tubing 12.

A check ball 74 is retained within return passage 36. Check ball 74 is adapted to be longitudinally movable within return passage 36, but to be capable of sealing against upper end surface 76 of by-pass tube 58. As can be seen particularly in FIG. 2A, return passage 36 includes a recess 78 which extends above the upper extent of radial apertures 38. As depicted in phantom in FIG. 2A, fluid pressure may then move check ball 74 into recess 78, where fluid flow through radial aperture 38 will not be diminished.

Ported sub 42 includes, in an inward portion thereof, a threaded coupling 80. Coupled to ported sub 42 through threaded coupling is base pipe 82. Base pipe 82 extends downwardly, on the interior of screen extension sub 44 and through gravel pack screen 46, to a location proximate, but above, the lowermost extent 82 of gravel pack screen 46. In this preferred embodiment, gravel pack screen of an exterior diameter of approximately 2.334 inches and an interior diameter of approximately 1.715 inch. Gravel pack screen may be of a number of conventional types known to the art, such as the wire wrapped rod base screen manufactured by Howard Smith Screen Company of Dallas, Tex. As is known to the art, such screen will have a plurality of external wraps of keystone shaped wire spirally wrapped around a plurality of vertical base rods. Base pipe 82 will extend within the diameter of these base rods.

Ported sub 42 is coupled to screen extension sub 44 through a shearable connection, indicated generally in 88. Shearable connection includes a radially inward downwardly extending flange 90 on ported sub 42 and a radially outward upwardly extending flange 92 on screen extension sub 44. Flanges 90 and 92 are coupled together through one or more shearable connections such as shear pins or shear screws 94. An O-ring seal 96 within screen extension sub 44 will sealingly engage the exterior of base pipe 82. It will be understood by those of skill in the art that the length of gravel pack screen 46, and of base pipe 82 will be determined in response to the dimension of the interval to be gravel packed.

In one intended manner of performing a through tubing gravel pack through use of gravel pack apparatus 10, gravel pack apparatus 10 will be lowered through an existing tubing string 12 on the end of a small diameter tubing string 24. Gravel pack apparatus will have been configured with a gravel pack screen 46 having a length appropriate for the interval to be gravel packed, which will be spaced through pup joint housing section 32 from upper housing such that when gravel pack screen is placed adjacent the interval to be gravel packed, tubing packer cup 64 will be within the bore of tubing string 12.

When gravel pack apparatus 10 is placed in the described location within the well, fluid will be circulated into the well through small diameter tubing string 24. This fluid will pass through flow passages 28, into fluid chamber 34, and to the formation through gravel pack flow ports 60. As will be apparent to those skilled in the art, fluid may be circulated into the well to test seals within the system, or the system may be acidized; or the gravel pack operation may be begun. The gravel pack slurry (possibly including a fluid pad) will be circulated through the described flow passage. As can be seen in reference to FIG. 1, as the gravel pack slurry is circulated, the gravel will be deposited in annulus 18, while the slurry fluid returns will pass through gravel pack screen 46, will travel through the interior thereof, and will enter lower end 96 of base pipe 82. The placement of lower end 96 of base pipe 82, proximate the lowermost extent 84 of gravel pack screen 46 should assist in assuring that an optimally dense gravel pack is established as the fluid returns travel downwardly to enter base pipe 82. The flow of the gravel slurry will typically continue until a pressure build up occurs, indicating that the portion of annulus 18 adjacent the entire length of gravel pack screen 46 has been filled with gravel.

After the pumping of the gravel slurry has ceased, it may be desirable to squeeze the pack. To squeeze the pack, pressure will be applied to the fluid column within exterior annulus 40 between gravel pack apparatus 10 (and small diameter tubing string 24) and tubing string 12. As this pressure is applied, as previously described, fluid will by-pass tubing packer cup 64 and will pass out of the termination 62 of tubing 12, where the fluid will apply pressure to the gravel pack 19. When fluid pressure it applied in exterior annulus 40, the fluid pressure will act upon check ball 74 in return passage 36, urging check ball 74 into a sealing relationship with upper end surface 76 of by-pass tube 58, assuring the application of fluid pressure in exterior annulus 40, and in annulus 18 below.

At the completion of any squeeze operations, the upper portion of gravel pack apparatus 10 will be removed from the well, leaving only the screen and bull plug within the well. Do to the friction created relative to the screen by the presence of the gravel pack 19, an upward strain applied through small diameter tubing string 24 should cause shearing of shear screws 94, allowing the assembly above (and including) ported sub 42, including base pipe 82 attached below to be removed from the well, leaving the gravel packed installation in place, and facilitating production from the well.

Figure 5:
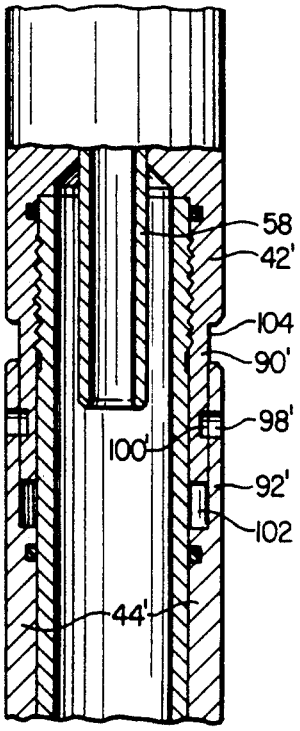
FIG. 5 depicts an alternative coupling arrangement for a washpipe assembly and screen assembly of the gravel pack apparatus of FIG. 2.

Referring now to FIG. 5, therein is depicted an alternative embodiment for separation assembly 88. The numbers of components in FIG. 5 similar, but not identical, to those previously identified have been identified with primes. Ported sub 42' once again, includes a radially inward downwardly extending flange 90' while screen extension sub 44' includes a radially outward upwardly extending flange 92'. Flange 92' will include an aperture 98' and flange 90' will include a recess 100' which are arranged such that when aperture 98' and recess 100' are in registry, a gap 102 will be formed beneath flange 90', and a gap 104 will be formed above flange 92'. With such an arrangement, when it is desired to shear shear screw 94, weight may merely be set down upon the gravel pack apparatus assembly, to thereby move flange 90' downwardly relative to flange 92' and to thereby shear screw 94. Subsequently, the two flanges should separate freely. As will be appreciated by those of skill in the art, this shearing of shear screw 94 may, in some operations, be accomplished initially upon placing the gravel pack apparatus in the borehole.

Many modifications and variations may be made in the techniques and structures described and illustrated herein without departing from the spirit and the scope of the present invention. Accordingly, it should be clearly understood that the technique and embodiments described and illustrated herein are illustrative only, and are not to be considered as limitations from the scope of the present invention.

What is claimed is:

1. An assembly for gravel packing a well in which a primary tubing string is installed, comprising:

a secondary tubing string of a dimension to be insertable through said primary tubing string;

a crossover assembly coupled to said secondary tubing string, said crossover assembly of a dimension to be insertable through said primary tubing string;

a screen assembly coupled to said crossover assembly;

a packer assembly coupled to said crossover assembly, said packer assembly configured to selectively establish a seal between at least a portion of said crossover assembly and said secondary tubing string.

2. The assembly of claim 1, wherein said crossover assembly defines a first flow passage extending between the interior of said secondary tubing string and the exterior of said secondary tubing string at a location beneath said packer assembly, and further defines a second flow passage providing fluid communication between a first location interior to said gravel pack screen to the exterior of said secondary tubing string above said packer assembly.

3. The assembly of claim 1, further comprising a selectively separable connection between said crossover assembly and said screen assembly.

4. The assembly of claim 1, wherein said packer assembly will permit the flow of fluid downwardly through the annulus formed between said secondary tubing string and said primary tubing string, but will substantially prevent the flow of fluid upwardly through said annulus.

5. The assembly of claim 1, wherein said assembly further comprises a base pipe, said base pipe operatively coupled to said crossover assembly, and extending to a location within said screen assembly.

6. An apparatus for placing a gravel pack in a well in which a tubing string is installed, such gravel pack to be placed through circulation of a slurry;

a crossover assembly insertable through said tubing string;

a screen coupled to said crossover assembly; and a packer assembly coupled to said crossover assembly, said packer assembly configured to selectively establish a seal between at least a portion of said crossover assembly and said tubing string.

7. The apparatus of claim 6, wherein said crossover assembly is adapted to be operatively coupled to a second tubing string, said second tubing string insertable through said first tubing string.

8. The apparatus of claim 7, wherein said crossover assembly establishes a first flow flow path between the interior of said second tubing string and the exterior of said crossover assembly beneath said packer assembly, and further establishes a second flow path between the interior of said screen and the exterior of said crossover assembly above said packer assembly.

9. A method of gravel packing a well in which a primary tubing string is installed, comprising:

lowering a gravel packing assembly through said primary tubing string, said gravel packing assembly comprising, a secondary tubing string, a crossover assembly coupled to said secondary tubing string, a screen assembly coupled to said crossover assembly, and a packer assembly operatively coupled to said crossover assembly, said gravel pack assembly lowered through said primary tubing string to a depth at which said screen is proximate the depth desired to be gravel packed and where said packer assembly selectively engages the interior of said primary tubing string;

circulating a gravel slurry through said secondary tubing string and through said crossover assembly to a location exterior to said screen assembly and receiving at least a portion of the slurry fluid through said screen assembly, through said crossover assembly and the annulus between said secondary tubing string and said primary tubing string.

10. The method of claim 9, wherein said packer assembly substantially prevents the upward flow of fluid through the annulus between said crossover assembly and said primary tubing string, but will allow the passage of fluid downwardly through said annulus between said crossover assembly and said primary tubing string.

11. The method of claim 9, wherein said gravel pack assembly includes a selectively separable connection between said crossover assembly and said gravel pack screen, and wherein said method further comprises the step of releasing said selectively releasable connection to remove said crossover assembly from said well while leaving said screen in said well.

12. The method of claim 8, wherein said crossover assembly establishes a first flow path between the interior of said secondary tubing string and the exterior of said crossover assembly beneath said packer assembly, and further establishes a second flow path between the interior of said screen and the exterior of said crossover assembly above said packer assembly.

13. The method of claim 9, wherein said gravel pack assembly further comprises a base pipe operatively coupled to said crossover assembly and extending to a location within said screen assembly.

14. The method of claim 11, wherein said gravel pack assembly further comprises a base pipe extending from said crossover assembly into said gravel pack screen, and wherein said step of releasing said selectively releasable connection to remove said crossover assembly from said well while leaving said screen in said well further comprises the removal of said base pipe from said well with said crossover assembly.

* * * * *